United States Patent [19]

Gay et al.

[11] Patent Number: 4,914,352

[45] Date of Patent: Apr. 3, 1990

[54] PLASMA PANEL WITH FOUR ELECTRODES PER PIXEL AND METHOD FOR THE CONTROL OF A PLASMA PANEL OF THIS TYPE

[75] Inventors: Michel Gay, Le Fontanil; Louis Delgrange, Saint Egreve; Michel Specty, Grenoble, all of France

[73] Assignee: Thomson-CSF, Paris, France

[21] Appl. No.: 156,938

[22] Filed: Feb. 17, 1988

[30] Foreign Application Priority Data

Feb. 20, 1987 [FR] France ..... 87 02205

[51] Int. Cl.[4] ..... G09G 3/10; G09G 3/20; H01J 17/00; H01J 61/00

[52] U.S. Cl. ..... 315/169.4; 313/581; 313/582; 313/584; 313/586; 340/752; 340/779; 340/781

[58] Field of Search ..... 315/169.4; 313/581, 313/582, 584, 586; 340/781, 752, 779

[56] References Cited

U.S. PATENT DOCUMENTS 3,886,404 5/1975 Kurahashi et al. ..... 340/769.4
3,952,230 4/1976 Sakai ..... 340/779
4,342,993 8/1982 Holz ..... 315/169.4

FOREIGN PATENT DOCUMENTS 0135382 of 0000 European Pat. Off. .

OTHER PUBLICATIONS

Dick "Three-Electrode-Per-Pel AC Plasma Display Panel", IEEE Transaction on Electron Devices, ED (1986) Aug., No. 8 New York, N.Y. U.S.A.

IBM Technical Disclosure Bulletin, vol. 25, No. 7B, Dec. 1982, pp. 3610-3611, New York, U.S.; M. O. Aboelfotoh: "Cyclic Gaseous Discharge Display Panel".

Electronic Engineering, vol. 55, No. 681, Sep. 1983, pp. 165=175, Londres, GB; A. Sobel: "Gas Discharge Displays", *FIG. 1*.

*Primary Examiner*—Eugene R. Laroche
*Assistant Examiner*—Michael B. Shingleton
*Attorney, Agent, or Firm*—Oblon, Spivak, McClelland, Maier & Neustadt

[57] ABSTRACT

The invention pertains to an alternating type of plasma panel. Each pixel is defined by three parallel and coplanar electrodes and by an electrode which is perpendicular to the other three electrodes and is separated from the other three electrodes by at least one dielectric layer. Two of the three parallel electrodes are connected to circuits giving the refresh signals to each pixel during operation. The electrode perpendicular to the other three and that electrode, of the other three parallel electrodes, which is not connected to a refresh circuit, are connected to circuits that give addressing signals to each pixel during operation. The electrodes that are connected to the refresh circuits constitute two arrays of electrodes connected to two refresh circuits.

7 Claims, 4 Drawing Sheets

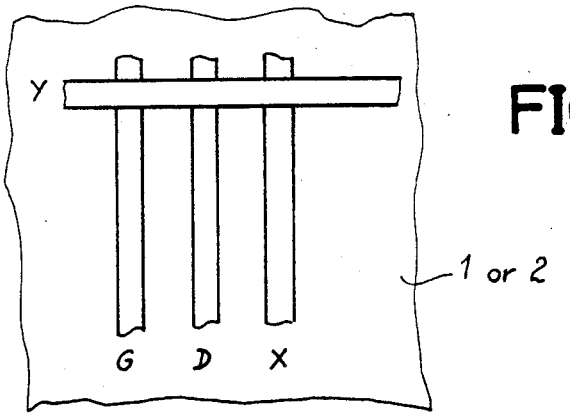
FIG_3
FIG_5
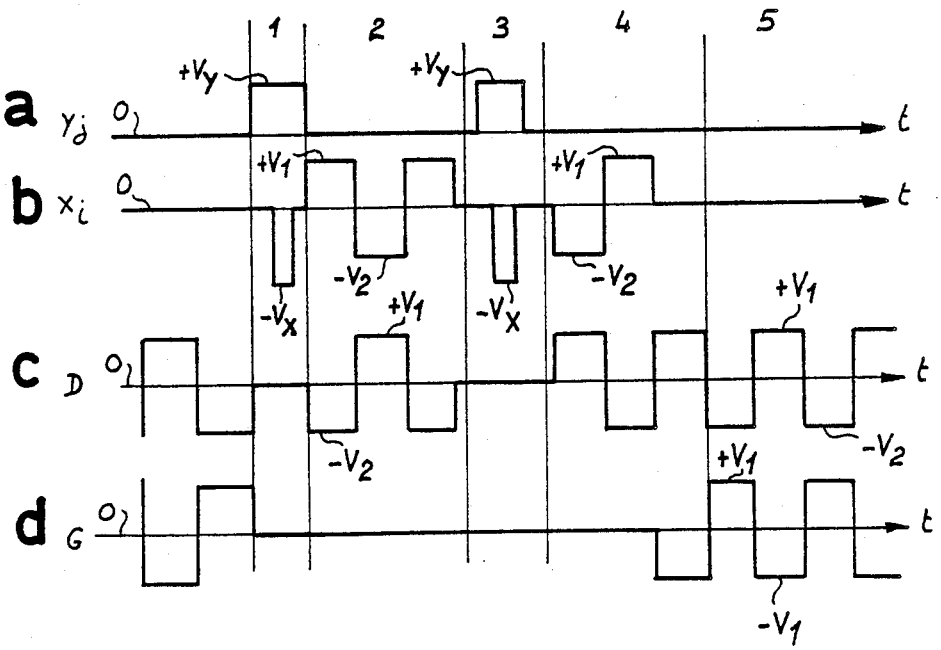

PLASMA PANEL WITH FOUR ELECTRODES PER PIXEL AND METHOD FOR THE CONTROL OF A PLASMA PANEL OF THIS TYPE

BACKGROUND OF THE INVENTION

1. Field of the Invention

The present invention pertains to alternating type plasma panels. It also pertains to methods for the control of these panels.

2. Description of the Prior Art

Alternating-type plasma panels, such as those currently in the market, comprise, as shown schematically in FIG. 1, two glass envelopes 1 and 2, with each envelope bearing an array of electrodes, $x_1,x_2,x_3...,y_1,y_2,y_3...$, that are parallel to one another and are lined with a dielectric layer 3. The two envelopes are mounted and sealed so that the two electrode arrays are perpendicular to each other, and so that there is a very small distance between the two facing dielectric layers 3. This space between the two dielectric layers is filled with a gas which is generally neon-based. Each pixel is defined by the intersection of two perpendicular electrodes. The display of data is done by the repeated lighting up of a luminescent discharge within the gas, by means of addressing and refresh signals conveyed by the electrodes. The addressing signals are used to create discharges or to eliminate the possibility of subsequent discharges for the selected pixels. The refresh signals are used to create periodic discharges for the pixels that are lit up.

This structure of a plasma panel with two electrodes per pixel has the advantages of technologicial simplicity of construction, sturdiness and the fact that it uses well-known electric control circuits. However, this structure has the following two disadvantages:

there is a large number of electrodes to be connected. Thus, for high-definition screens where it is sought to control 1000 pixels, a minimum of 2000 electrodes have to be connected. Consequently, the connections to be made and the control circuits of these screens are generally more costly than the panel itself;

in practice, it has proved to be difficult, with plasma panels using two electrodes per pixel, to obtain any color other than the conventional orange-red of neon.

For, the obtaining of light of another color, with high luminous efficiency and, even more so, the simultaneous restitution of several colors, requires that one or more layers of luminophores be deposited on the dielectric layers 3, the said luminophores converting the ultra-violet radiation generated by the discharges into visible light. In conventional structures with two electrodes per pixel, problems are raised by the depositing of these luminophores, their positioning with respect to the electrodes and their deterioration caused by the ions present in the discharges.

Plasma panel structures other than the conventional one shown in FIG. 1 have been proposed. None of them has been entirely satisfactory.

For example, we might refer to a panel structure with three electrodes per pixel, described in the European patent 0.135.382. This structure is shown in FIG. 2.

Each pixel is defined by two parallel and coplanar electrodes, X and Y, and by an electrode Z, perpendicular to the other two. In FIG. 2, the three electrodes, X, Y, and Z, are borne by the same glass envelope 1. The dielectric layer 3 insulates the electrodes X and Y from the electrode Z, and also covers the electrode Z. Consequently, the glass envelope 2 bears no electrodes and can, therefore, receive luminophores that emit the desired color or colors by photoluminescence. The addressing signals are applied to the crossed electrodes Z and X or Z and Y, and the refresh signals are applied to the parallel electrodes X and Y. The refreshing is thus done by creating lateral discharges between the two parallel and coplanar electrodes, X and Y.

The European patents, 0.135.382 and 0.157.248, describe methods to control the plasma panels shown in FIG. 2. These methods make it possible to reduce the number of control circuits, but, on the other hand, the number of connections may be increased.

Thus, in the case of a panel with 1024 pixels, depending on the control method used the number of control circuits varies between 64 and 1025 and the number of connections varies between 1056 and 1025.

Furthermore, as in the case of panels with two electrodes per pixel, the control circuits are complicated because the same electrodes, X or Y, are used for both addressing and refreshing and, while the addressing signals are low powered, the refresh signals are high powered.

The present invention pertains to a new alternating type of plasma panel structure.

SUMMARY OF THE INVENTION

The present invention pertains to an alternating type of plasma panel, comprising several pixels, each pixel being defined by electrodes perpendicular to one another, connected to circuits that give, during operation, addressing signals and refresh signal to each pixel, wherein each pixel is defined by three parallel and coplanar electrodes and by an electrode which is perpendicular to the other three electrodes and is separated from the other three electrodes by at least one dielectrical layer, two of the three parallel electrodes being connected to circuits giving, during operation, the refresh signals to each pixel, while the electrode perpendicular to the other three as well as that electrode, of the three parallel electrodes, which is not connected to a circuit giving the refresh signals during operation, are connected to circuits that give addressing signals to each pixel during operation.

The invention also pertains to methods for the control of a plasma panel of this type.

Among the main advantages of the panel according to the invention, we might mention:

The simplification of the control circuits: in the panel of the invention, the addressing and refresh functions are fulfilled by separate electrodes. Furthermore, in a first preferred embodiment of the invention, the electrodes of the panel that receive the refresh signals are connected in two arrays D and G. Consequently, two high-power control circuits suffice to apply the refresh signals. Moreover, in a second preferred embodiment of the invention where, as compared with the first preferred embodiment of the invention, one of the three parallel electrodes, namely the one that conveys the addressing signals, is common to two neighbouring rows of pixels, the number of pixel-addressing control circuits that are connected to these electrodes can be reduced by half. Consequently, the invention makes it possible to reduce the cost and increase the reliability of the control circuits;

Reduction of the number of connections, especially in the two preferred embodiments of the invention referred to in the above paragraph: this reduction does not call for any crossing of electrodes and leads to a reduction in cost;

The possibility of addressing each pixel separately: this feature is especially valuable when only a part of the data displayed on the panel has to be modified. With the panels of the invention, it is quite possible to address the panel line by line or point by point;

an improvement in luminance, for equal consumption levels, as compared with standard panels having two electrodes per pixel.

BRIEF DESCRIPTION OF THE DRAWINGS

Other objects, features and results of the invention will emerge from the following description, given as a non-restrictive example and illustrated by the appended figures, of which:

FIG. 3 is a drawing representing the four electrodes defining each pixel in the plasma panels according to the invention;

FIGS. 5*a* to 5*d* and 7*a* to 7*d* show control signals for the panels of FIGS. 4 and 6;

DESCRIPTION OF PREFERRED EMBODIMENTS

In the various figures, the same references are repeated for the same elements. However, for reasons of clarity, the dimensions and proportions of the various elements are not the same.

In the plasma panel of the invention, each pixel is defined by four electrodes as is shown schematically in FIG. 3.

FIG. 3 shows that a pixel is defined, firstly, by three parallel electrodes, G, D, X, and secondly, by an electrode Y, perpendicular to the other three electrodes.

Figure 1:
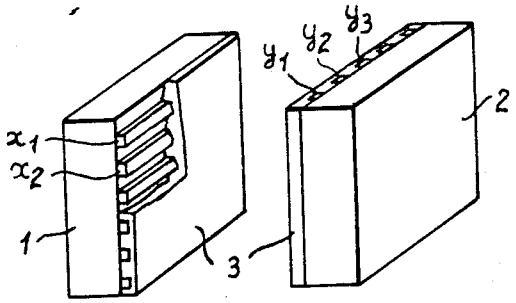
FIG 1 PRIOR ART
FIGS. 1 and 2 are drawings illustrating the structure of two embodiments of plasma panels according to the prior art.
Figure 2:
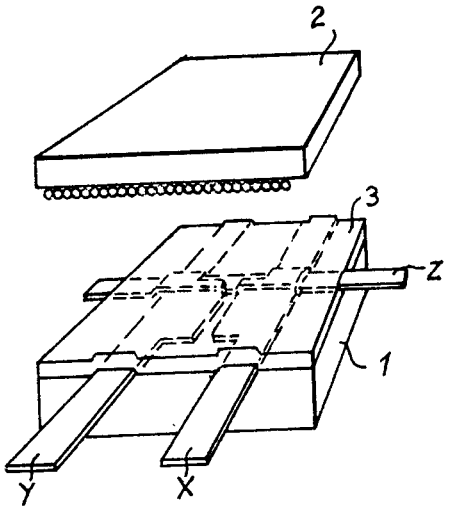
FIG 2 PRIOR ART

The three electrodes, G, D and X, are located in one and the same plane on one and the same support, which may be one of the two glass envelopes, 1 or 2, comprising the panel: see for example, in FIG. 1 pertaining to the prior art, the two glass envelopes, references 1 and 2.

The electrode Y is separated from the other three electrodes G, D, X, by at least one dielectrical layer.

In FIG. 3, the electrode Y is borne by the same glass screen 1 or 2 as the electrodes G, D, X; in this case, a dielectrical layer, not shown in FIG. 3, separates the electrodes G, D, X and Y, and covers also the electrode or electrodes located towards the inside of the panel. The electrode Y can also be borne by the other glass envelope, which does not bear the electrodes G, D, X. In this case, a dielectrical layer covers the electrode Y and another dielectrical layer covers the electrodes G, D, X. In FIG. 1, the reference 3 designates these dielectrical layers which cover the electrodes.

Two of the three parallel electrodes, for example the electrodes G and D, are used to convey the refresh signals. This is therefore a coplanar type of refreshing. The two perpendicular electrodes X and Y are used to convey the addressing signals.

It is therefore clear that, in the plasma panels of the invention, the addressing and refreshing functions are fulfilled by separate electrodes, thus enabling the use of electronic circuits that are well-suited to the high power required by refresh signals and to the low power required by the addressing signals, thus making it possible to use high-impedance circuits for the addressing signals. It is also clear that the plasma panels of the invention can be used to address each pixel separately, since each pixel is addressed by two given perpendicular electrodes. Of course, the addressing can also be done line by line.

Figure 4:
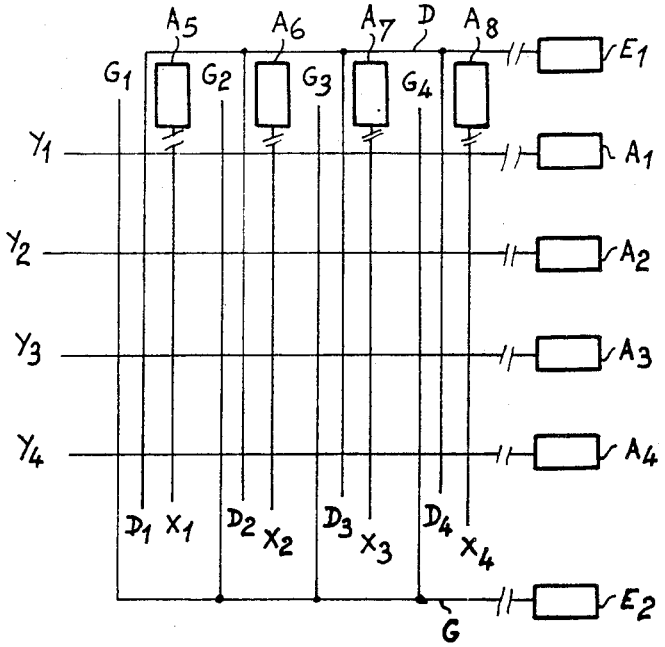
FIGS. 4 and 6 are schematic representations of two embodiments of plasma panels according to the invention.

FIG. 4 represents a plasma panel according to the invention in a schematic view, i.e. in a view showing its electrodes only.

The panel of FIG. 4 comprises four lines and four columns of pixels.

As in FIG. 3, each pixel is defined by four electrodes Y and G, D, X.

In FIG. 4, the electrodes used are designated by $Y_1$ to $Y_4$, $G_1$ to $G_4$, $D_1$ to $D_4$ and $X_1$ to $X_4$.

The electrodes $G_1$ to $G_4$ and $D_1$ to $D_4$ are connected to one another and create four arrays called D and G.

The creation of the two arrays D and G makes it possible to restrict to two the number of circuits $E_1$ and $E_2$ which give, during operation, the refresh signals to each pixel and are needed for the functioning of the panel.

The electrodes $Y_1$ to $Y_4$ and $X_1$ to $X_4$ are connected to circuits called $A_1$ to $A_8$ which, during operation, give the addressing signals to each pixel.

FIGS. 5*a*, 5*b*, 5*c* and 5*d* show the signals conveyed by the electrodes $Y_j$, $X_y$ (with i=1 to 4 and j=1 to 4), D and G so as to address and refresh the pixels of a panel according to the invention. What is shown in FIGS. 5*a* to 5*d* is only one method, among others, for the control of a panel according to the invention.

At the top of FIG. 5*a*, we show how the various stages 1, 2, 3, 4, 5, comprising the control of the panel, are distributed as a function of time t on the x axis.

The stage 1 is an initialization stage during which a discharge is created among all the electrodes $X_i$ and $Y_j$ of the panel, so as to conduct charges of a given signal towards each electrode $X_i$. These charges are located in the space corresponding to the intersection of the electrodes $X_i$ and $Y_j$. For this, it can be seen in FIGS. 5*a* and 5*b* that, during the stage 1, a positive voltage pulse with a value $+V_Y$ is applied to the electrode $Y_j$, and a negative voltage pulse with a value $-V_x$ is applied to the electrode $X_i$, $V_Y$ and $V_X$ being positive values. Between the electrodes considered, $X_i$ and $Y_j$, a potential difference sufficient to create a discharge is created.

During the stage 2, the charges created at the electrode $X_1$ during the stage 1 are transferred to the electrode D. This is done in keeping the electrodes $Y_j$ and G at the reference potential, taken as equal to 0V for example, and in applying voltage levels, of an amplitude successively equal to $+V_1$ and $V_2$ and in opposite phase, to the electrodes $X_Y$ and D. Thus, between the electrode $X_i$ and the electrode D, a discharge or an odd number of discharges is created. The effect of each discharge is to reverse the sign of the charges thus transferred to the electrode D. An odd number of discharges leads to a result that is identical and quite stable.

Stage 3 is an addressing stage during which a discharge can be created between the electrodes $X_i$ and $Y_j$, if it is sought to light up a given pixel. Hence, a selective addressing of each pixel is done, this operation being also known as random addressing. In the embodiment of the control signals shown in FIG. 5*a* to 5*d*, the electrodes D and G have 0 volts during the stage 3. The electrode $Y_j$ receives a voltage pulse equal to $+V_Y$. As for the electrode $X_i$, it goes to $-V_X$ if it is sought to put the pixel considered in the lit-up state. If it is sought to extinguish a pixel or keep it in the extinguished state, it suffices that the two voltages indicated above are not present simultaneously at the two electrodes $Y_j$ and $X_i$.

During stage 3, if a pixel is lit up, there is a reversal of the charges stored in the electrode $X_i$.

During the stage 4, there is a succession of discharges between the electrodes $X_i$ and D. This is obtained by applying, to these electrodes, voltage levels, in opposite phase and of an amplitude successively equal to $+V_1$ and $-V_2$.

The stage 5 is a refresh stage during which the electrodes $Y_j$ and $X_i$ are at the reference potential, equal to zero volts for example, and the electrodes G and D receive voltage levels, in opposite phase and of an amplitude successively equal to $+V_1$ and $-V_2$. Hence, a succession of discharges is created between the electrodes D and G.

A truly random addressing is done to light up or extinguish a pixel without thereby modifying the state of the other pixels for, during the stages 1 and 3, signals have to be applied to the electrodes $X_i$ and $Y_j$. Other non-random addressing operations are possible with the same structure, for example, line by line addressing.

Figure 6:
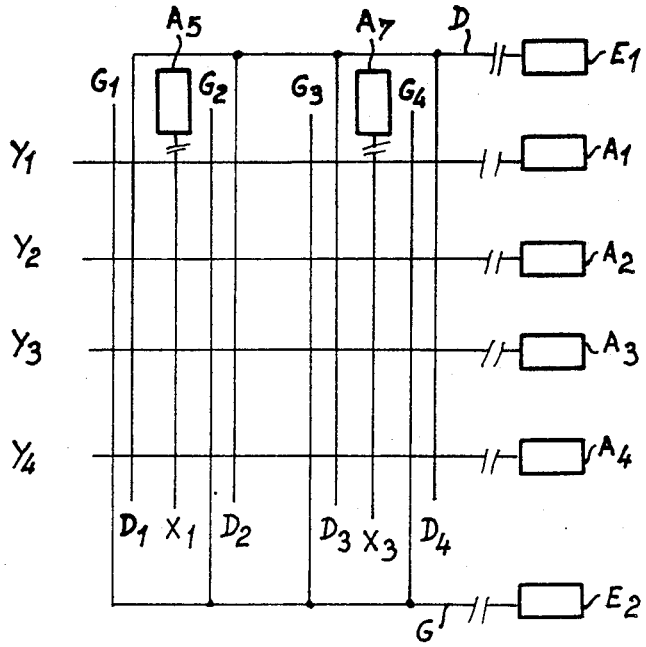

FIG. 6 represents another embodiment of a panel according to the invention. This panel differs from that of FIG. 4 in that the electrodes $X_2$ and $X_4$ are eliminated and the electrodes $X_1$ and $X_3$, connected to the circuits $A_5$ and $A_7$, are common to two neighbouring columns of pixels. This embodiment therefore makes it possible to reduce the number of connections and the number of selection circuits while, at the same time, preserving the possibility of performing a random addressing operation.

In the embodiment of FIG. 6, for a panel comprising 1024 rows of pixels, it is necessary to use only two high-powered refresh circuits and sixteen low powered addressing circuits, each having 32 bits, whereas panels known up to now require at least 64 refresh circuits.

For n rows of pixels, the panels of the invention require only $n/2+2$ connections on one of the sides of the panel, and n connections on the other side.

FIGS. *7a, 7b, 7c* and *7d* show an example of the addressing signals $Y_j$, $X_i$, D and G of the panel of FIG. 6.

A panel of this type requires a succession of two types of stages called the stages 10, 20, 30, 40, 50 and the stages 100, 200, 300, 400, 500. The stages 10 to 50 are used to address the pixels located to the left of the electrodes $X_1$ and $X_3$. The stages 100 to 500 are used to address the pixels which are located to the right of the electrodes $X_1$ and $X_3$ and for which the role of the electrodes G and D is reversed with respect to the pixels located to the left of the electrodes $X_1$ and $X_3$.

The control signals shown in FIGS. *7a* to *7d* during the stages 10, 20, 30, 40, 50, are identical to the control signals shown in FIGS. 5*a* to 5*d*. The control signals shown in FIGS. *7a* to *7d* during the stages 100 to 500 differ from those of the stages 10 to 50 only with respect to the signals applied to the electrodes D and G which have been inverted.

This modification corresponds to the position of the electrodes in FIG. 6, where the electrodes $X_1$ and $X_3$ are framed at the left by the electrodes $D_1$ and $D_3$ and, at the right, by the electrodes $G_2$ and $G_4$.

During the addressing stage 20, the charge transfer described for the stage 2 occurs only between the electrodes $X_1$, $X_3$ and their neighbouring electrodes $D_1$ and $D_3$. By contrast, this transfer does not occur between the electrodes $X_1$, $X_3$ and the electrodes $D_2$ and $D_4$ because the electrodes $G_2$ and $G_4$ are interposed between the electrodes $X_1$, $D_2$ and $X_3$, $D_4$. Consequently, during the stage 30, only the pixels located to the left of the electrodes $X_1$ and $X_3$ can be addressed, for the refresh pulses that have occurred during the stage 20 could occur only between the electrodes $D_1$, $X_1$ and $D_3$, $X_3$.

During the stage 200, on the contrary, there can be refresh pulses only between the electrodes $G_2$ and $X_1$ and $G_4$ and $X_3$. Consequently, during the stage 300, only the pixels located to the right of the electrodes $X_1$ and $X_3$ can be addressed.

Figure 7:
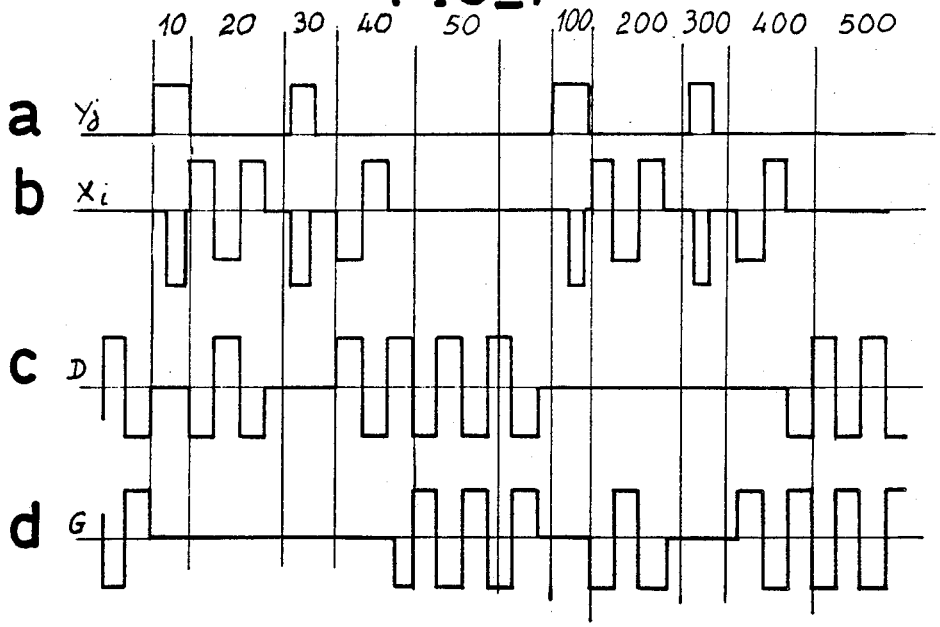

As in the case of FIG. 5, the addressing signals of FIG. 7 are given only by way of example.

Of course, the invention also pertains to plasma panels in which, as in FIG. 6, an electrode such as $X_1$, $X_3$..., used for addressing, is common to two neighbouring rows of pixels but for which, unlike what is shown in FIG. 6, the electrodes $D_1$ to $D_4$ and $G_1$ to $G_4$ are not in two arrays D and G.

Figure 8:
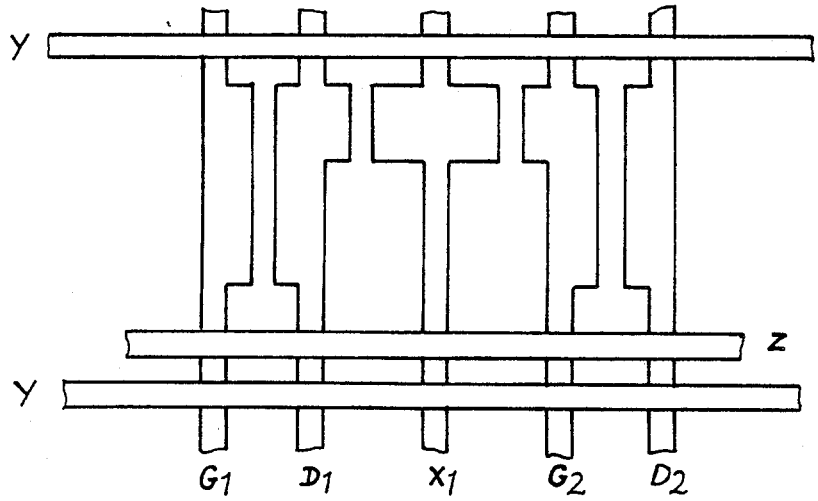
FIG. 8 shows an alternative embodiment of FIG. 3.

FIG. 8 shows a special embodiment of a panel according to the invention, wherein the electrodes G, D, X, which are parallel to one another, no longer have the shape of a strip but are crenelated. This shape of the electrodes provides for better locating of the discharges corresponding to each pixel. It is clear that the discharges remain localized between those portions of electrodes that are closest to one another.

FIG. 8 also shows an electrode Z, parallel to and coplanar with the electrodes Y, which is also used to locate discharges at each pixel.

These electrodes Z, which are referred to in the above-mentioned European patent 0.135.382, are called separation electrodes. They may be either electrically floating electrodes or they may be connected to a voltage source.

What is claimed is:

1. An alternating type of plasma panel, comprising several pixels, each pixel being defined by electrodes perpendicular to one another, connected to circuits that give, during operation, addressing signals and refresh signals to each pixel, wherein each pixel is defined by three parallel and coplanar electrodes and by an electrode which is perpendicular to the three parallel and coplanar electrodes and is separated from the three parallel and coplanar electrodes by at least one dielectric layer, two of the three parallel electrodes being connected to circuits giving, during operation, the refresh signals to each pixel, while the electrode which is perpendicular to the three parallel and coplanar electrodes as well as that electrode, among the three parallel electrodes, which is not connected to a circuit giving refresh signals during operation, are connected to circuits giving the addressing signals to each pixel during operation.

2. A panel according to claim 1 wherein the two parallel electrodes, connected to circuits giving refresh signals to each pixel during operation, are respectively each connected to another identical electrode of the panel so as to form two arrays of electrodes connected to two circuits giving the refresh signals to each pixel during operation.

3. A panel according to either of the claims 1 or 2 wherein that electrode, of the three parallel electrodes, which is connected to a circuit giving the addressing signals during operation, is common to two neighbouring rows of pixels, and wherein the plasma panel comprises the following repetition of groups of five electrodes parallel to one another:

a first electrode and a second electrode connected to circuits giving refresh signals to each pixel during operation;

a third electrode connected to a circuit giving the addressing signals to each pixel during operation;

a fourth electrode and a fifth electrode connected to circuits giving the refresh signals to each pixel during operation, the fourth electrode receiving the same signals as the first one, and the fifth electrode receiving the same signals as the second one.

4. A panel according to claim 1, wherein the three parallel and coplanar electrodes have a crenelated shape so as to provide for a more efficient locating of discharges among parallel electrodes.

5. A panel according to claim 1, wherein each pixel comprises a separation electrode which is substantially parallel to the electrode perpendicular to the other three electrodes.

6. A method for the control of a panel according to claim 1, comprising the repetition of the following five stages:

a first stage during which a discharge is created between the two electrodes receiving the addressing signals;

a second stage during which at least one discharge is created between that electrode, of the three parallel and coplanar electrodes, which receives the addressing signals and one of the other two parallel and coplanar electrodes;

a third stage during which, when it is sought to register a pixel, a discharge is created between the two electrodes that receive the addressing signals;

a fourth stage during which a succession of discharges is created between the same electrodes as those concerned in the second stage;

a fifth stage during which a succession of discharges is created between the electrodes receiving the refresh signals.

7. A method for the control of a panel according to claim 6, comprising the repetition of the five stages defined in claim 6 with discharges, during the second and fourth stages, between that electrode, among the three parallel and coplanar electrodes, which receives the addressing signals, and one of the other two parallel and coplanar electrodes, and then the repetition of the five stages defined in claim 6 with, during the second and third stages, discharges between that electrode, of the three coplanar and parallel electrodes, which receives the addressing signals, and that electrode, of the other two parallel and coplanar electrodes, which has not been used in the previous five stages.

* * * * *